US009109336B1

(12) United States Patent
Firth

(10) Patent No.: US 9,109,336 B1
(45) Date of Patent: Aug. 18, 2015

(54) APPARATUS FOR BUILDING A SQUEEGEE SHOVEL

(71) Applicant: Leland Firth, Sanford, MI (US)

(72) Inventor: Leland Firth, Sanford, MI (US)

( * ) Notice: Subject to any disclaimer, the term of this patent is extended or adjusted under 35 U.S.C. 154(b) by 0 days.

(21) Appl. No.: 14/576,005

(22) Filed: Dec. 18, 2014

Related U.S. Application Data

(63) Continuation of application No. 14/242,039, filed on Apr. 1, 2014, now abandoned.

(51) Int. Cl.
*E01H 5/02* (2006.01)

(52) U.S. Cl.
CPC ..... *E01H 5/02* (2013.01); *Y10T 29/53961* (2015.01)

(58) Field of Classification Search
CPC ..... Y10T 29/53265; Y10T 29/53961; Y10T 29/53; E01H 5/02
USPC ..... 52/127.1, 741.1; 269/37, 40, 287, 269/289 R, 329, 907, 909; 37/241, 266, 37/285; 15/117, 121, 245
See application file for complete search history.

(56) References Cited

U.S. PATENT DOCUMENTS

| | | | | | |
|---|---|---|---|---|---|
| 3,134,129 | A * | 5/1964 | Allen | 401/138 |
| 3,545,060 | A * | 12/1970 | Kezran | 407/103 |
| 3,867,659 | A * | 2/1975 | Seaburg | 310/242 |
| 5,117,530 | A * | 6/1992 | Rank | 15/245 |
| 5,528,793 | A * | 6/1996 | Schbot | 15/245 |
| D393,130 | S * | 3/1998 | Murphy | D34/24 |
| 7,975,339 | B2 * | 7/2011 | Gavney, Jr. | 15/1.7 |

* cited by examiner

*Primary Examiner* — Jamie L McGowan
(74) *Attorney, Agent, or Firm* — James A. Italia; Italia IP

(57) ABSTRACT

A squeegee shovel for propelling a mass of fluent material along a surface. The squeegee shovel has a blade including a principal panel, and a right wing and a left wing each arranged at an acute angle to the principal panel. Reinforcing bars at the bottom of the blade sandwich the blade and a strip of plastic. A socket for receiving a pole type handle is fixed to one of the reinforcing bars.

4 Claims, 4 Drawing Sheets

APPARATUS FOR BUILDING A SQUEEGEE SHOVEL

CROSS-REFERENCE TO RELATED APPLICATION

This application is a Continuation Application and claims the benefit of the filing date of U.S. patent application Ser. No. 14/242,039, filed Apr. 1, 2014, the contents of which are incorporated herein by reference.

FIELD OF THE INVENTION

The present invention relates to a tool for scraping a surface and propelling a mass of fluent material along the surface, and method and apparatus for making the tool.

BACKGROUND OF THE INVENTION

Fluent masses, such as sand, water, snow, bulk insulation materials, gravel, wet cement, and the like must from time to time be moved along a surface, such as a floor, driveway, bulk holding facility, or the like. When moving small amounts of these masses, such as to maneuver sand or insulation materials into place, or to remove snow from driveways, sidewalks, and the like, it is practical to have a single person push or pull the mass along the surface, using a suitable tool.

SUMMARY OF THE INVENTION

The present invention provides a tool well adapted to moving masses of fluent material along generally horizontal surfaces by one person. The tool comprises a broad blade for engaging the mass, and a long pole style handle. The blade has two extensions or wings projecting from the principal panel of the blade at acute angles thereto.

A method of making the tool and a related fixture are also described.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
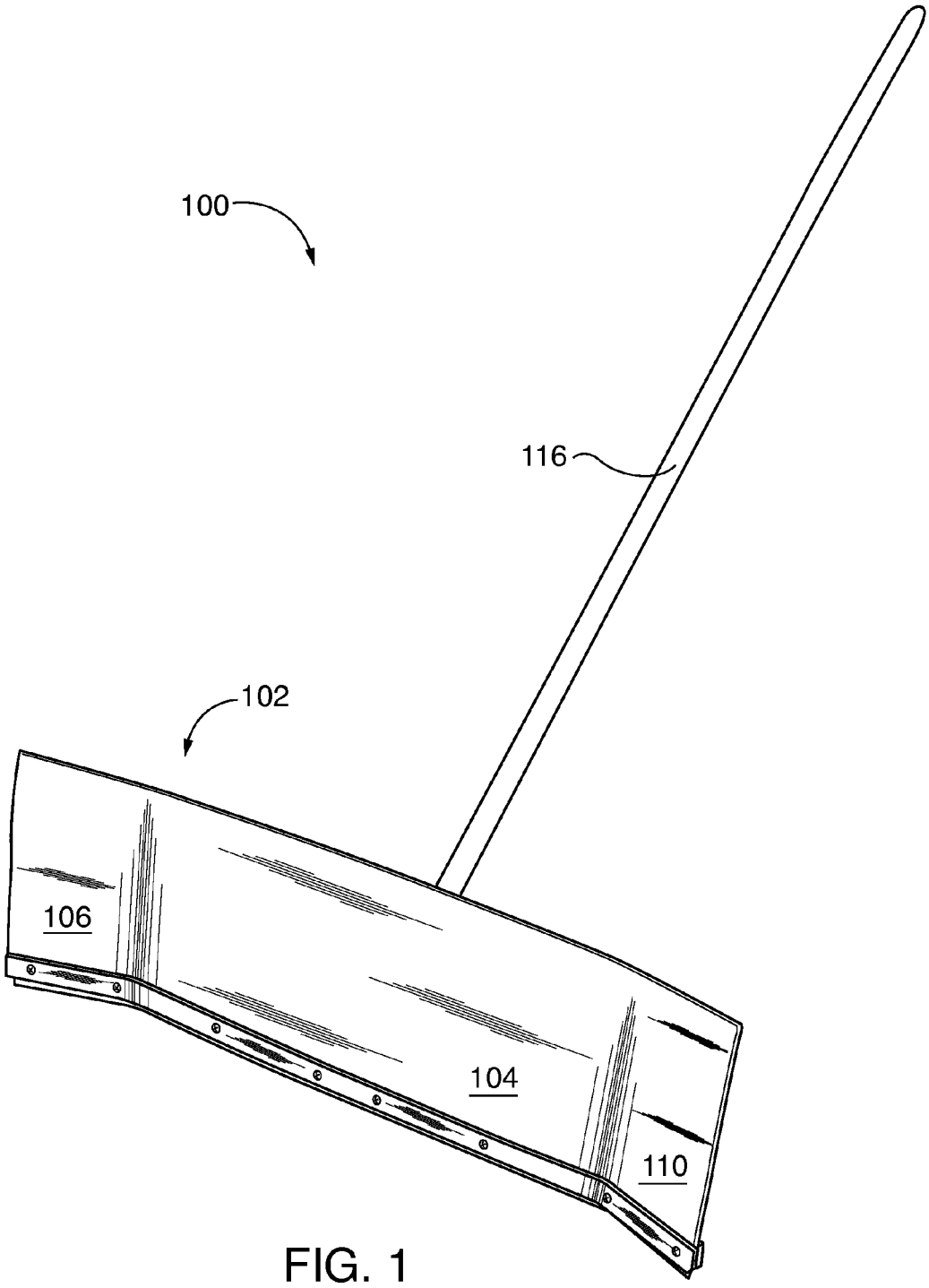
FIG. 1 is a front perspective view of a squeegee shovel according to the present disclosure.
Figure 2:
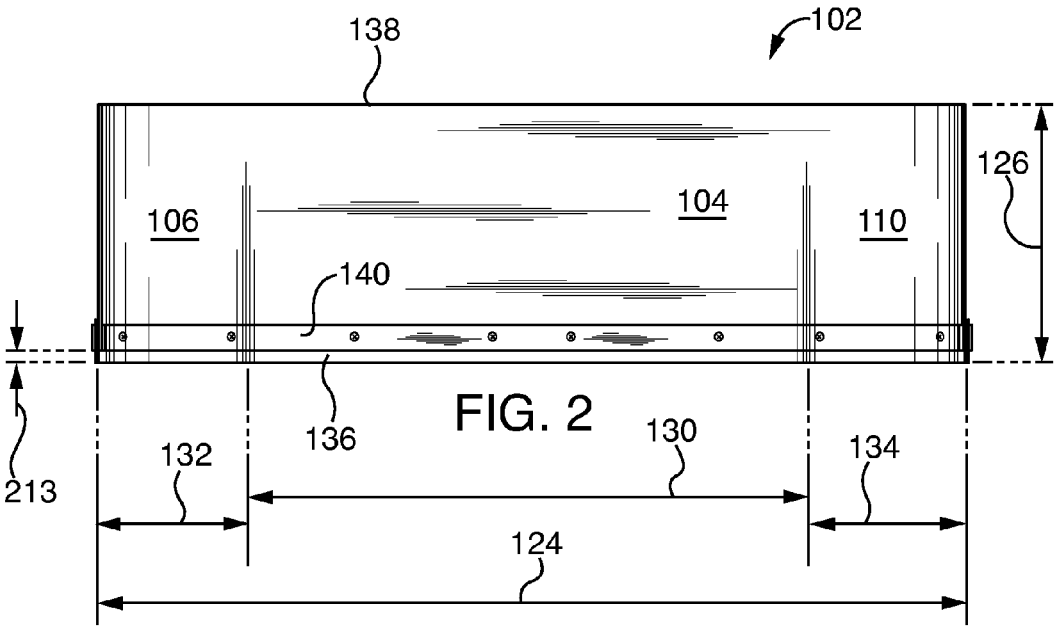
FIG. 2 is a front view of the blade assembly of the squeegee shovel of FIG. 1.
Figure 3:
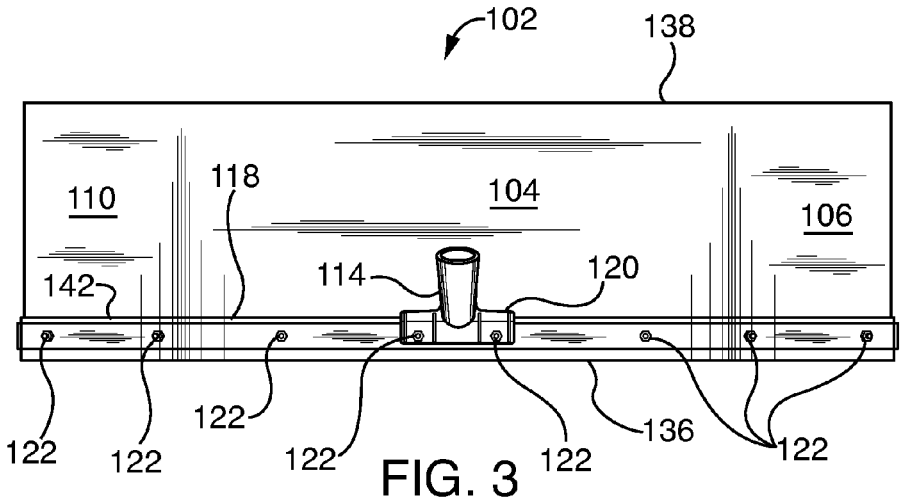
FIG. 3 is a rear view of FIG. 2.

Referring first to FIG. 1, according to at least one aspect of the invention, there is shown a squeegee shovel 100 for propelling fluent material (not shown) along a surface (not shown). The squeegee shovel 100 includes a blade 102 having a central panel 104, a right wing 106 projecting from the central panel 104 at an acute angle 108 (see FIG. 5) thereto, and a left wing 110 projecting from the central panel 104 at an acute angle 112 (See FIG. 5) thereto. FIG. 2 shows the blade 102 in front view. FIG. 3 shows the blade 102 in rear view. In FIG. 3, a socket 114 is seen fixed to the blade 102, for receiving a pole type handle 116 (FIG. 1) fixed to the socket 114. The pole type handle 116 may be fabricated from wood, metal, or a synthetic resin, for example, and may be solid or hollow. The socket 114 may be crimped over the pole type handle 116 to fix the latter in place, for example. Alternatively, a pin or screw and nut combination may penetrate the pole type handle 116 and the socket 114.

The socket 114 is not directly fixed to the blade 102. Rather, a first rigid reinforcing bar 118 extending along the blade 102 is interposed between the socket 114 and the blade 104. The socket 114 will be understood to include a suitable web extension web 120 for receiving fasteners 122, to facilitate mounting the socket 114 to the first rigid reinforcing bar 118. Additional fasteners 122 fasten the first rigid reinforcing bar 118 to the blade 102.

Referring again to FIG. 2, the blade 102 has a length 124 extending along the first rigid reinforcing bar 118 (although in FIG. 2, a second rigid reinforcing bar 128 is seen), and a height 126 extending perpendicularly to the length 124. The central panel 104 of the blade 102 has a length 130 along the length of the blade 102. The right and left wings 106, 110 each have respective transverse dimensions 132, 134 along the length 124 of the blade 102. The length 130 of the central panel 104 is greater than the transverse dimensions 132, 134 of the right and left wings 106, 110.

Exemplary dimensions for a representative squeegee shovel 100 which is usable by one person in the manner of using a broom or hand shovel are as follows. The length 124 of the blade 102 may be in a range of thirty to forty-two inches. More particularly, the length 124 of the blade 102 may be about thirty-six inches, allowing for minor deviations due to manufacturing tolerances, for example. The height 126 of the blade 102 may be in a range of eight to fifteen inches. More particularly, the height 126 of the blade 102 may be about ten and one half inches, allowing for minor deviations.

As seen in FIG. 3, the first rigid reinforcing bar 118 is located along a lower edge 136 of the blade 102. Also, it will be noted that the socket 114 opens upwardly, towards an edge 138 of the blade 102 which is opposed to the edge 136.

It should be noted at this point that orientational terms such as upwardly, bottom, right, and left refer to the subject drawing as viewed by an observer. The drawing figures depict their subject matter in orientations of normal use, which could obviously change as the squeegee shovel 100 with changes in body posture and position of a person (not shown) using the squeegee shovel 100. Therefore, orientational terms must be understood to provide semantic basis for purposes of description only, and do not imply that their subject matter can be used only in one position or orientation.

FIG. 2 shows a second rigid reinforcing bar 140 extending along the blade 102 on a side of the blade 102 opposite that side bearing the first rigid reinforcing blade 118. As may be seen by comparing FIGS. 2 and 3, the second rigid reinforcing blade 140 is located in registry with the first rigid reinforcing blade 118. Alternatively stated, the first and second rigid reinforcing blades 118, 140 extend along corresponding areas of the blade 102, but on opposite sides thereof. The first rigid reinforcing bar 118 is relatively thick, compared to the second rigid reinforcing bar 140, which accordingly is relatively thin.

Illustratively, the first rigid reinforcing bar 118 may be fabricated from aluminum strip one quarter inch in thickness, with the second rigid reinforcing bar 140 being fabricated from aluminum strip one eighth inch in thickness.

The blade 102 may be fabricated from vinyl plastic sheet.

Figure 4:
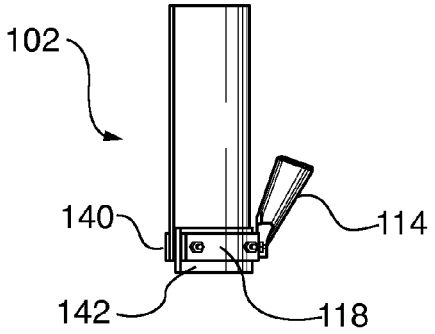
FIG. 4 is a left side view of FIG. 2.
Figure 5:
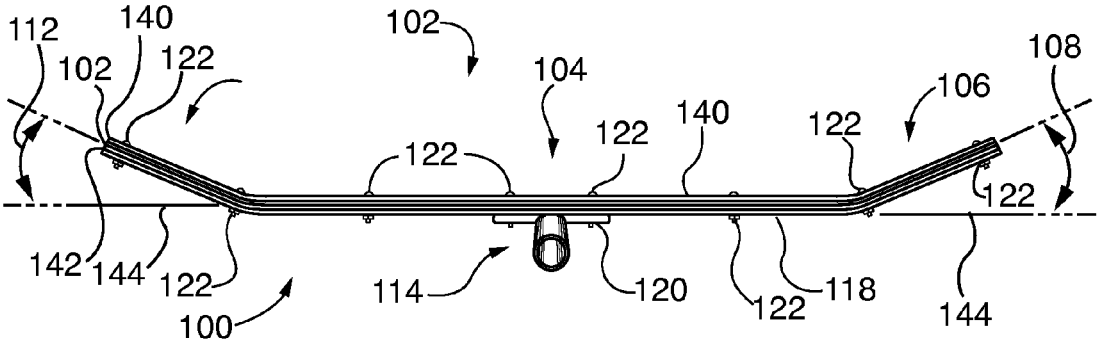
FIG. 5 is top view of FIG. 2.

Turning now to FIGS. 4 and 5, it is seen that the squeegee shovel 100 further comprises a strip of neoprene rubber 142 between the first rigid reinforcing bar and the blade. The fasteners 122, which may be screws or bolts with associated nuts, for example, clamp the first rigid reinforcing bar 118, the strip of plastic sheet 142, the blade 102, and the second rigid reinforcing bar 140 together. The fasteners 122 are provided in sufficient numbers and at spacing intervals such that the elements clamped by the fasteners 122 do not objectionably separate from one another.

In FIG. 4, it will be seen that the neoprene rubber strip 142 and the blade 102 are exposed below the first and second rigid reinforcing bars 118, 140. Because the neoprene rubber strip 142 and the blade 102 are somewhat pliable, the squeegee shovel 100 can yield to immovable irregularities in the surface along which the squeegee shovel 100 is being moved.

FIG. 5 clearly shows that the socket 114 is one side of the blade 102, and that the right and left wings 106, 110 are on an opposed side of the blade 102. In FIG. 5, opposed sides of the blade 102 are above and below the projection line 144.

Figure 6:
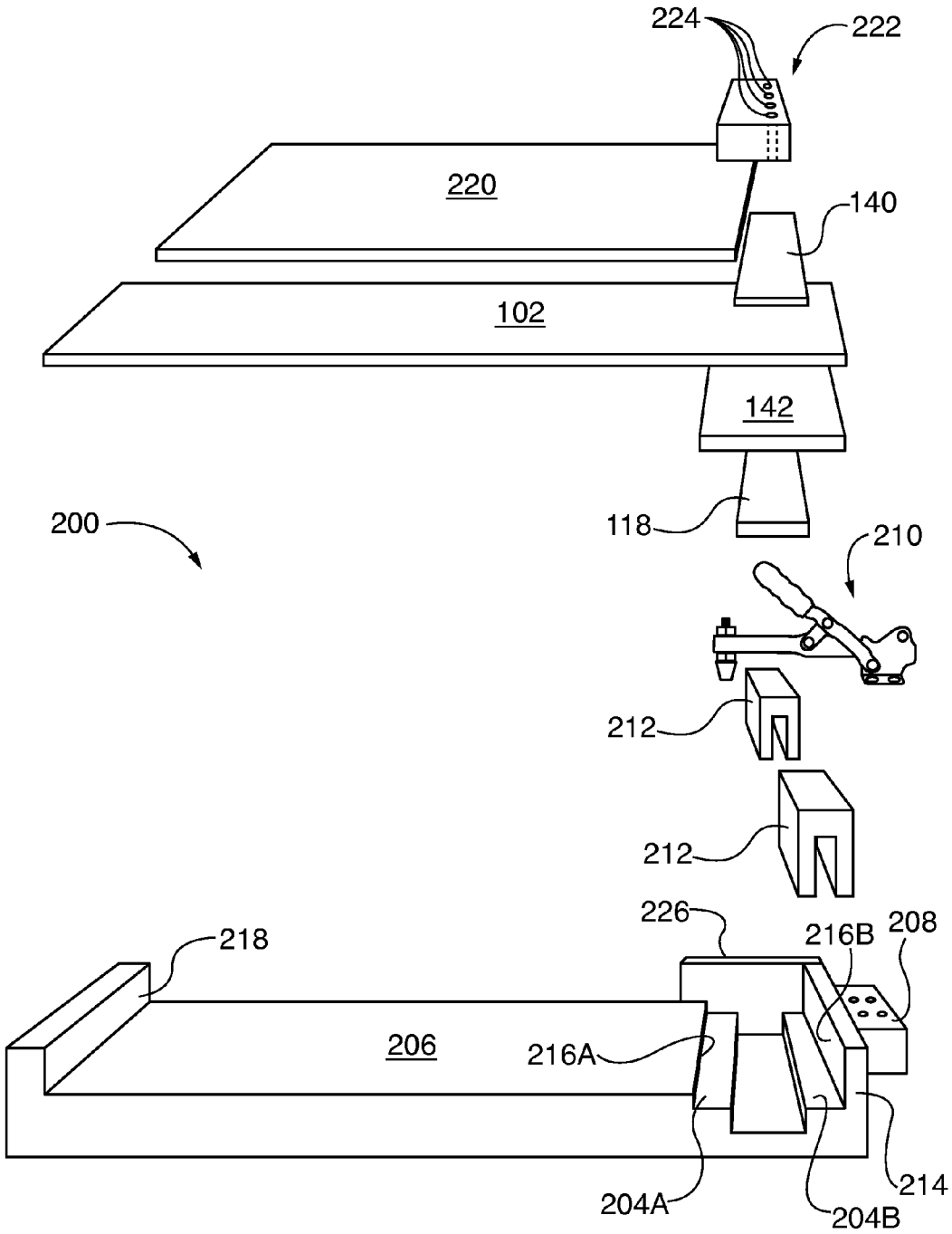
FIG. 6 is a diagrammatic exploded view of the blade assembly of FIG. 2 and a fixture for assembling the squeegee shovel.

FIG. 6 shows a fixture 200 which may be utilized to assemble the blade assembly of the squeegee shovel 100 (shown disassembled in the exploded view of FIG. 6). The fixture 200 includes a bed defining a first transverse groove 202, a second transverse groove (shown as comprising a left portion 204A and a right portion 204B), and a bed 206. The fixture 200 may include a structural extension 208 for mounting one or more clamps 210. One or two spacers 212 are configured to be lowered over and be supported by a right end wall 214.

To assemble a squeegee shovel blade assembly, the first rigid reinforcing bar 118 is laid in the first transverse groove 202. The first transverse groove is dimensioned to receive the first rigid reinforcing bar 118 in close cooperation therewith. As employed herein, close cooperation signifies that the subject component can be easily inserted into and removed from the receiving groove (e.g., the first transverse groove 202), but is constrained against sliding spontaneously therein to an extent which would interfere with the assembly operation. Next, the neoprene rubber strip 142 is laid above the first rigid reinforcing bar 118 in the second transverse groove portions 204A and 204B. The second transverse groove portions 204A, 204B have respective abutment surfaces 216A, 216B which together receive the neoprene rubber strip 142 in close cooperation. Next, the blade 102 is laid above the neoprene rubber strip 142. The blade 102 is received in close cooperation between the abutment surface 216A and an opposed end wall 218. Next, the spacers 212 are lowered into engagement with the right end wall 214. The second rigid reinforcing bar 140 is then laid over the blade 102. The second rigid reinforcing bar 140 is spaced to the left away from the 216B by the spacers 212. The distance of separation is indicated as a gap 213 in FIG. 2. The first rigid reinforcing bar 118 is similarly spaced to the left of the abutment surface 216B by the location and dimensions of the first transverse groove 202.

A spacer 220 which spans the distance between the left side of the second rigid reinforcing bar 140 and the end wall 218 may be installed just above the blade 102.

A hole template 222 having a plurality of holes 224 may then be lowered onto the second rigid reinforcing bar 140. The hole template 222, the first and second rigid reinforcing bars 118, 140, the blade 102, and the neoprene rubber strip 142 are appropriately aligned by pressing towards a backstop 226. The clamp 210 may then be brought to impose a clamping force on the hole template 222, the first and second rigid reinforcing bars 118, 140, the blade 102, and the neoprene rubber strip 142. A drill (not shown) such as an electric hand drill is then used to drill holes through the first and second rigid reinforcing bars 118, 140, the blade 102, and the neoprene rubber strip 142. The fasteners 122 may then be installed in the drilled holes. The fixture 200 is then disassembled, and the squeegee shovel blade assembly is then removed therefrom. The assembled squeegee shovel blade assembly may then be brought to a vice and bent to form the wings 106, 110. The pole type handle 116 may then be installed in the socket 114.

The fixture 200 may be modified in various ways. For example, the extension 208 may be made larger than as illustrated, and more than one clamp 210 may be provided. The bed of the fixture 200 may be provided as separate, installable and removable pieces. The backstop 226 may be extended to the left, for example, extending to the end wall 218 if desired.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A fixture for assembling a blade assembly of a squeegee shovel, comprising:

a bed having a right end and an opposed left end;

an upwardly facing bed surface between the right end and the opposed left end;

a right end wall spanning the bed at the right end thereof and projecting above the upwardly facing bed surface, and an opposed left end wall at the left end of the bed and spanning the bed at the left end thereof and projecting above the upwardly facing bed surface, the right end wall presenting a first abutment surface facing the left end of the bed, wherein the bed defines a first transverse groove spanning the bed, located below the upwardly facing bed surface proximate the right end of the bed, and defining a second abutment surface and a second transverse groove comprising a right portion proximate the right end wall and facing the left end of the bed, the right portion and the left portion each having a horizontal surface below the upwardly facing bed surface and an opposed left portion facing the right end of the bed, wherein the second transverse groove is above and wider than the first transverse groove;

a backstop closing one end of the first and second transverse grooves;

a structural extension projecting from the right end of the bed;

at least one clamp separate from the bed and mountable to the structural extension;

at least one first spacer separate from the bed and, when oriented along the first groove, is configured to be lowered over, engage, and be supported by the right end wall;

a second spacer having a length equal to the distance from the left end wall to the second abutment surface and a width about equal to that of the upwardly facing bed surface, wherein the second spacer is separate from the bed; and a hole template having a plurality of holes oriented perpendicularly to the upwardly facing bed surface of the bed, wherein the hole template is separate from the bed.

2. A method of assembling a blade assembly of a squeegee shovel using a fixture including a bed having a right end and an opposed left end; an upwardly facing bed surface between the right end and the opposed left end; a right end wall spanning the bed at the right end thereof and projecting above the upwardly facing bed surface, and an opposed left end wall at the left end of the bed and spanning the bed at the left end thereof and projecting above the upwardly facing bed surface, the right end wall presenting a first abutment surface facing the left end of the bed, wherein the bed defines a first transverse groove spanning the bed, located below the upwardly facing bed surface proximate the right end of the bed, and defining a second abutment surface and a second transverse groove comprising a right portion proximate the right end wall and facing the left end of the bed, the right portion and the left portion each having a horizontal surface below the upwardly facing bed surface and an opposed left portion facing the right end of the bed, wherein the second transverse groove is above and wider than the first transverse groove; a backstop closing one end of the first and second transverse grooves; a structural extension projecting from the right end of the bed; at least one clamp separate from the bed and mountable to the structural extension; at least one first spacer separate from the bed and, when oriented along the first groove, is configured to be lowered over, engage, and be supported by the right end wall; a second spacer having a length equal to the distance from the left end wall to the second abutment surface and a width about equal to that of the upwardly facing bed surface, wherein the second spacer is separate from the bed; and a hole template having a plurality of holes oriented perpendicularly to the upwardly facing bed surface of the bed, wherein the hole template is separate from the bed, the method comprising:

laying a first rigid reinforcing bar in the first transverse groove;

laying a neoprene rubber strip above the first rigid reinforcing bar in the second transverse groove portions;

laying a blade of the squeegee shovel above the neoprene rubber strip;

lowering the spacers into engagement with the right end wall;

laying a second rigid reinforcing bar over the blade, with the second rigid reinforcing bar spaced to the left away from the first abutment surface by the at least one spacer;

installing a spacer which spans the distance between the left side of the second rigid reinforcing bar and the end wall just above the blade;

lowering the hole template having the plurality of holes onto the second rigid reinforcing bar;

aligning the hole template, the first and second rigid reinforcing bars, the blade, and the neoprene rubber strip by pressing the hole template, the first and second rigid reinforcing bars, the blade, and the neoprene rubber strip towards the backstop;

imposing a clamping force on the hole template, the first and second rigid reinforcing bars, the blade, and the neoprene rubber strip by using the clamp;

drilling holes through the first and second rigid reinforcing bars, the blade, and the neoprene rubber strip, using the holes of the hole template to locate each one of the drilled holes;

installing fasteners in the drilled holes to unite the first and second rigid reinforcing bars, the blade, and the neoprene rubber strip into a squeegee shovel blade assembly; and removing the fixture from the squeegee shovel blade assembly.

3. The method of claim 2, further comprising bending the squeegee shovel blade assembly to form wings therein.

4. The method of claim 3, further comprising:

mounting a socket on the squeegee shovel blade assembly; and installing a pole type handle in the socket.

* * * * *